US008413551B2

(12) United States Patent
Hu

(10) Patent No.: US 8,413,551 B2
(45) Date of Patent: Apr. 9, 2013

(54) OPEN-END WRENCH

(76) Inventor: Bobby Hu, Taichung (TW)

( * ) Notice: Subject to any disclaimer, the term of this patent is extended or adjusted under 35 U.S.C. 154(b) by 176 days.

(21) Appl. No.: 13/161,596

(22) Filed: Jun. 16, 2011

(65) Prior Publication Data

US 2012/0318105 A1 Dec. 20, 2012

(51) Int. Cl.
*B25B 13/08* (2006.01)

(52) U.S. Cl. ..... 81/119; 81/121.1

(58) Field of Classification Search ..... 81/119, 81/121.1, 125.1
See application file for complete search history.

(56) References Cited

U.S. PATENT DOCUMENTS

| | | | | |
|---|---|---|---|---|
| 2,687,056 | A * | 8/1954 | Foor | 81/125.1 |
| 5,074,171 | A | 12/1991 | Annis et al. | 81/119 |
| 2008/0196557 | A1 * | 8/2008 | Wu | 81/119 |
| 2009/0229426 | A1 * | 9/2009 | Wu | 81/121.1 |

* cited by examiner

*Primary Examiner* — David B Thomas
(74) *Attorney, Agent, or Firm* — Alan Kamrath; Kamrath IP Lawfirm, P.A.

(57) ABSTRACT

An open-end wrench includes a jaw portion having two engaging portions and an opening between the engaging portions. Each engaging portion includes a driving face having a tip. A corner is formed between a bottom end of the opening and each driving face. A first length is defined between the bottom end in a direction perpendicular to an imaginary line passing through the tips. A spacing between the tips is larger than 0.95 times the first length and smaller than 1.05 times the first length. Two corners of a fastener received in the opening are located on the imaginary line and flush with the tips. Each engaging portion has a width at an associated corner in a direction perpendicular to an associated driving face. The width is the maximum distance from each driving face to an outer surface of the associated engaging portion. The width is larger than 0.2975 times a width between two parallel sides of the fastener and smaller than 0.4025 times the width of the fastener.

2 Claims, 3 Drawing Sheets

OPEN-END WRENCH

BACKGROUND OF THE INVENTION

The present invention relates to an open-end wrench and, more particularly, to an open-end wrench having enhanced structural strength and a reduced volume suitable for driving a fastener in a limited space through a larger angle.

FIG. 1 shows a conventional open-end wrench 30 including a handle 31 and a jaw portion 32. Jaw portion 32 includes first and second engaging portions 321 and 322 and an opening 323 between first and second engaging portions 321 and 322. Opening 323 includes an arcuate bottom end 3231. First engaging portion 321 includes a first driving face 3211 on a side of opening 323, and second engaging portion 322 includes a second driving face 3221 on the other side of opening 323. First and second driving faces 3211 and 3221 are parallel to each other. A corner A3 is formed between bottom end 3231 of opening 323 and first driving face 3211. Another corner A4 is formed between bottom end 3231 of opening 323 and second driving face 3221. In use, the first and second driving faces 3211 and 3221 are engaged with a pair of parallel sides 22 of a fastener 20 having a corresponding size. Fastener 20 has six corners a-f. Bottom end 3231 abuts a corner d of fastener 20. A user can grip handle 31 and drive jaw portion 32 to rotate fastener 20 through engagement between first and second driving faces 3211 and 3221 and two parallel sides 22 of fastener 20. However, each of first and second driving faces 3211 and 3221 of open-end wrench 30 has a length L3, L4 that is much larger than the length of side 22 of fastener 20 such that a tip of each of first and second driving faces 3211 and 3221 will extend deep into a space in which fastener 20 is located. Furthermore, a width H3 from corner A3 of opening 323 to an outer surface of first engaging portion 321 is in proportion to length L3, and a width H4 from corner A4 of opening 323 to an outer surface of second engaging portion 322 is in proportion to length L4. Thus, widths H3 and H4 of open-end wrench 30 are relatively large due to the long lengths L3 and L4, causing restriction of use of open-end wrench 30 in limited spaces. Furthermore, rotation of open-end wrench 30 is often smaller than 60°. In some positions in a limited space, widths H3 and H4 may hinder disengagement of jaw portion 32 from fastener 20 for subsequent operation. Although the user may try to change the holding direction of open-end wrench 30, the operation is difficult or even impossible to proceed with further rotation of another 60°.

U.S. Pat. No. 5,074,171 discloses an open-end wrench with reduced size jaws. A distance between the throat recess and an imaginary line connecting the tips of the jaws is smaller than the across-flats dimension, preferably 0.86 times the across-flats dimension. Each jaw has a distance or maximum width at each of two corners of the throat recess. The maximum width defined between each of two driving faces to an associated outer surface of the jaw of the open-end wrench (corresponding to width H3, H4 of conventional open-end wrench 3 of a corresponding size) is smaller than conventional designs and is preferably 0.5 times the across-flats dimension. Thus, the open-end wrench of U.S. Pat. No. 5,074,171 has a reduced volume and a reduced weight as well as enhanced structural strength. However, the contact between the fastener and inner ends of the relief regions of the tips will cause damage to the serrated portions of the driving faces. Furthermore, the reduction in size of the open-end wrench of U.S. Pat. No. 5,074,171 is small, although the maximum width of each jaw at each corner of the throat recess is 0.5 times the across-flats dimension, providing little help in use of the open-end wrench in limited spaces. Further, the size reduction of the body of the open-end wrench of U.S. Pat. No. 5,074,171 is little, providing little reduction in the overall weight and the overall volume and still adversely affecting operation in limited spaces.

BRIEF SUMMARY OF THE INVENTION

An open-end wrench according to the present invention includes a jaw portion and a handle. The jaw portion includes first and second engaging portions and an opening between the first and second engaging portions. The opening includes an arcuate bottom end. The first engaging portion includes a first driving face on a side of the opening. The second engaging portion includes a second driving face on the other side of the opening. The first and second driving faces are parallel to each other. Each of the first and second driving faces has a tip. A first corner is formed between the bottom end of the opening and the first driving face. A second corner is formed between the bottom end of the opening and the second driving face. An imaginary line passes through the tips of the first and second driving faces. The opening is adapted to receive a fastener including six sides. Two parallel sides of the fastener are engaged with the first and second driving faces. The fastener includes six corners and a width between two parallel sides of the fastener.

A first length is defined between the bottom end of the opening in a direction perpendicular to the imaginary line. A spacing between the tips is larger than 0.95 times the first length and smaller than 1.05 times the first length. When the fastener (20) is received in the opening, a corner of the fastener is received in the bottom end, another two corners of the fastener are located on the imaginary line and flush with the tips. The first engaging portion has a first width at the first corner in a direction perpendicular to the first driving face. The first width is the maximum distance from the first driving face to an outer surface of the first engaging portion. The second engaging portion has a second width at the second corner in a direction perpendicular to the second driving face. The second width is the maximum distance from the second driving face to an outer surface of the second engaging portion. Each of the first and second widths is larger than 0.2975 times the width of the fastener and smaller than 0.4025 times the width of the fastener.

Preferably, a second length is defined between the bottom end of the opening and an interconnection between bottoms of the first and second engaging portions in the direction perpendicular to the imaginary line. The second length is larger than 0.51 times the first length and smaller than 0.69 times the first length.

The present invention will become clearer in light of the following detailed description of illustrative embodiments of this invention described in connection with the drawings.

DETAILED DESCRIPTION OF THE INVENTION

Figure 2:
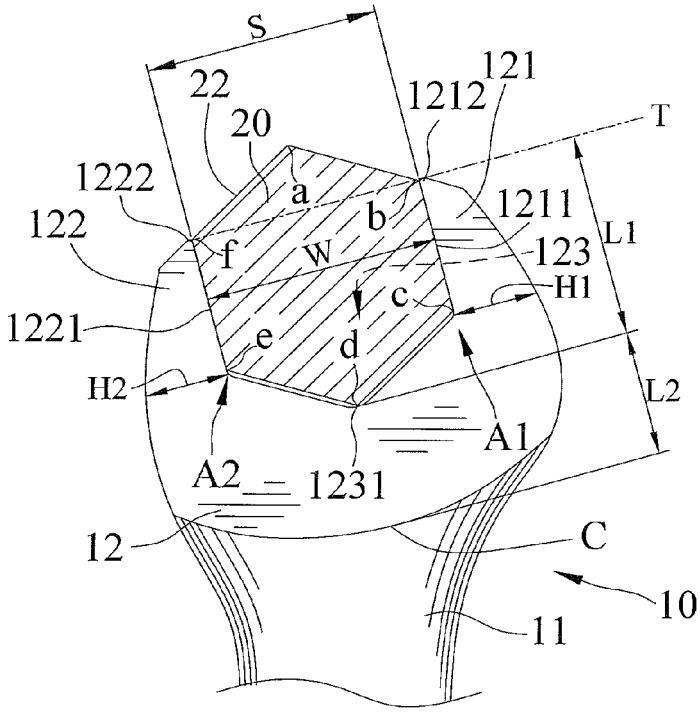
FIG. 2 shows a partial, side view of an open-end wrench according to the present invention and a fastener.
Figure 3:
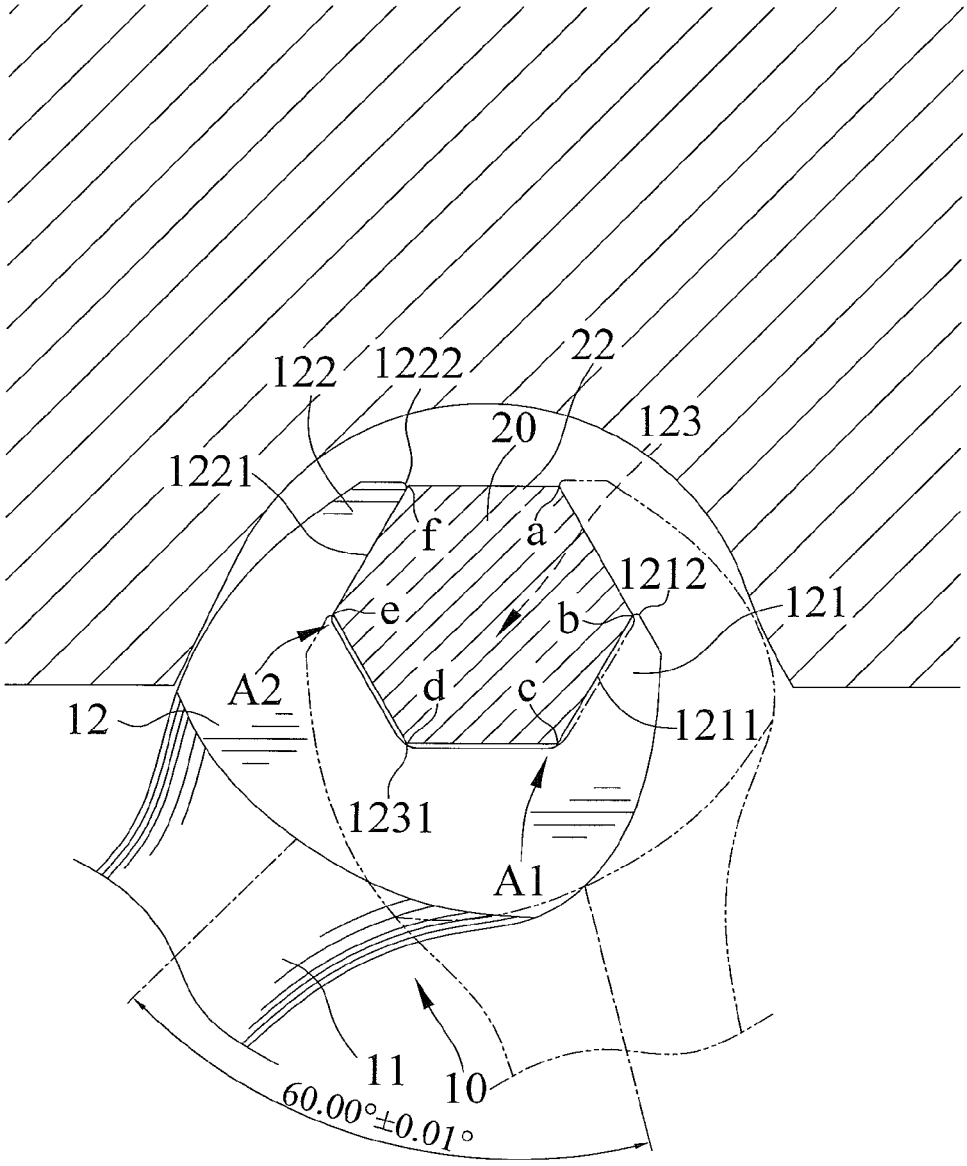
FIG. 3 shows a partial, side view of the open-end wrench and the fastener of FIG. 2 with the open-end wrench rotated through an angle.

With reference to FIGS. 2 and 3, an open-end wrench 10 according to the present invention includes a jaw portion 12 and a handle 11 extending from jaw portion 12 and allowing a user to grip. Jaw portion 12 includes first and second engaging portions 121 and 122 and an opening 123 between first and second engaging portions 121 and 122. Opening 123 includes an arcuate bottom end 1231. First engaging portion 121 includes a first driving face 1211 on a side of opening 123, and second engaging portion 122 includes a second driving face 1221 on the other side of opening 123. First and second driving faces 1211 and 1221 are parallel to each other. Furthermore, each of first and second driving faces 1211 and 1222 has a tip 1212, 1222. A first corner A1 is formed between bottom end 1231 of opening 123 and first driving face 1211. A second corner A2 is formed between bottom end 1231 of opening 123 and second driving face 1221.

In use, the first and second driving faces 1211 and 1221 are engaged with a pair of parallel sides 22 of a fastener 20 having a corresponding size. Fastener 20 has six corners a-f and a width W between two parallel sides 22. Bottom end 1231 abuts a corner d of fastener 20. A user can grip handle 11 and drive jaw portion 12 to rotate fastener 20 through engagement between first and second driving faces 1211 and 1221 and two parallel sides 22 of fastener 20.

An imaginary line T passes through tips 1212 and 1222 of first and second driving faces 1211 and 1221. A first length L1 is defined between bottom end 1231 and each tip 1212, 1222 in a direction perpendicular to imaginary line T. When fastener 20 is received in opening 123 with a corner d of fastener 20 received in bottom end 1231, another two corners b and f of fastener 20 are located on imaginary line T and flush with tips 1212 and 1222. A spacing S between tips 1212 and 1222 is larger than 0.95 times first length L1 and smaller than 1.05 times first length L1 ($0.95*L1<S<1.05*L1$).

Furthermore, first engaging portion 121 has a first width H1 at first corner A1 in a direction perpendicular to first driving face 121. First width H1 is the maximum distance of first engaging portion 121 from first driving face 1211 to the outer surface of first engaging portion 121. Second engaging portion 122 has a second width H2 at second corner A2 in a direction perpendicular to second driving face 122. Second width H2 is the maximum distance of second engaging portion 122 from second driving face 1221 to an outer surface of second engaging portion 122. Each of first and second widths H1, H2 is larger than 0.85*35% * W (width of fastener 22) and smaller than 1.15*35% *W (width of fastener 22) ($0.2975*W<H1<0.4025*W$, $0.2975*W<H2<0.4025*W$).

Furthermore, a second length L2 is defined between bottom end 1231 and an interconnection C between bottoms of first and second engaging portions 121 and 122 in the direction perpendicular to imaginary line T. Second length L2 is larger than 0.85*60%*L1 and smaller than 1.15*60%*L1 ($0.51*L1<L2<0.69*L1$).

Figure 1:
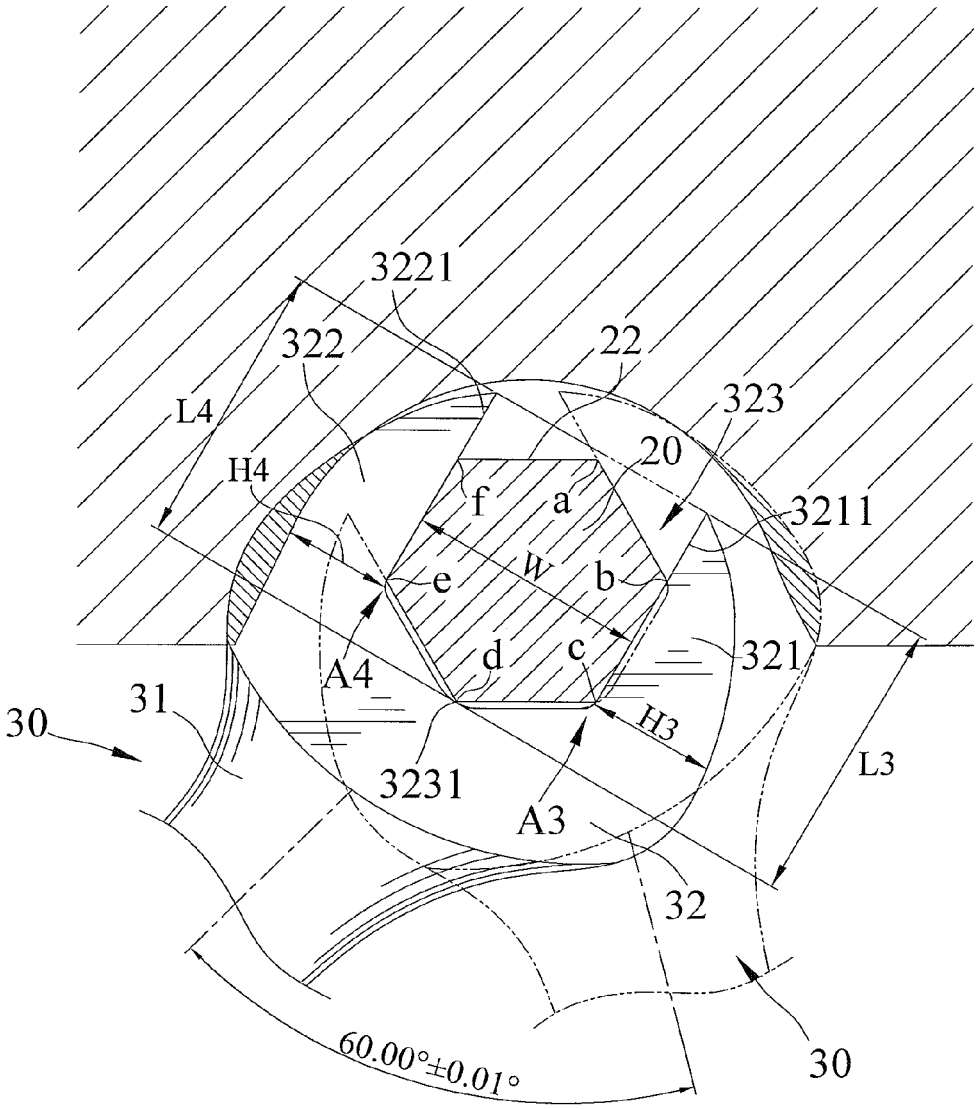
FIG.1 PRIOR ART
FIG. 1 shows a partial, side view of a conventional open-end wrench and a fastener.

By such arrangements of first and second lengths L1 and L2 and first and second widths H1 and H2, open-end wrench 10 according to the present invention has a reduced volume and a reduced size while having enhanced structural strength. Compared to conventional open-end wrench 30 of FIG. 1, the structure at the first and second corners A1 and A2 that have the maximum shear force during driving of fastener 20 is small in size but strong enough to withstand the shear force by providing the specific first and second widths H1 and H2, allowing open-end wrench 30 to rotate 60° in the same space where fastener 20 locates and allowing the user to disengage open-end wrench 30 from fastener 20 and reengage open-end wrench 30 with fastener 20 while holding open-end wrench 30 in the same direction.

Furthermore, due to provision of the specific first length L1, tips 1212 and 1222 of first and second engaging portions 121 and 122 are flush with two corners b and f of fastener 20 received in opening 123 during operation. This provides sufficient contact between first and second driving faces 1211 and 1221 with two parallel sides 22 of fastener 20 to avoid undesired loss in transmission of force. Furthermore, due to provision of the specific second length L2, the volume of the inner part of jaw portion 12 adjacent handle 11 is reduced. Thus, the maximum widths of first and second engaging portions 121 and 122 are reduced to be closer to first and second widths H1 and H2 at first and second corners Al and A2 while having sufficient structural strength. Comparatively, to obtain sufficient structural strength, conventional open-end wrenches must include larger widths by having outwardly extending arcs that extend to an extent beyond those at first and second widths H1 and H2 of open-end wrench 10 according to the present invention and then converge to handle 11.

While the specific embodiment has been illustrated and described, numerous modifications come to mind without significantly departing from the spirit of invention, and the scope of invention is only limited by the scope of the accompanying claims.

The invention claimed is:

1. An open-end wrench comprising a jaw portion and a handle, with the jaw portion including first and second engaging portions and an opening between the first and second engaging portions, with the opening including an arcuate bottom end, with the first engaging portion including a first driving face on a side of the opening, with the second engaging portion including a second driving face on the other side of the opening, with the first and second driving faces parallel to each other, with each of the first and second driving faces having a tip, with a first corner formed between the bottom end of the opening and the first driving face, with a second corner formed between the bottom end of the opening and the second driving face, with an imaginary line passing through the tips of the first and second driving faces, with the opening adapted to receive a fastener including six sides, with two parallel sides of the fastener engaged with the first and second driving faces, with the fastener including six corners and a width between two parallel sides of the fastener, characterized in that:

a first length is defined between the bottom end of the opening in a direction perpendicular to the imaginary line, a spacing between the tips is larger than 0.95 times the first length and smaller than 1.05 times the first length ($0.95*L1<S<1.05*L1$), when the fastener is received in the opening, a corner of the fastener is received in the bottom end, another two corners of the fastener are located on the imaginary line and flush with the tips, the first engaging portion has a first width at the first corner in a direction perpendicular to the first driving face, the first width is the maximum distance from the first driving face to an outer surface of the first engaging portion, the second engaging portion has a second width at the second corner in a direction perpendicular to the second driving face, the second width is the maximum distance from the second driving face to an outer surface of the second engaging portion, each of the first and second widths is larger than 0.2975 times the width of the fastener and smaller than 0.4025 times the width of the fastener (02975*W<H1<0.4025*W, 0.2975*W<H2<0.4025*W).

2. The open-end wrench as claimed in claim 1, characterized in that: a second length is defined between the bottom end of the opening and an interconnection between bottoms of the first and second engaging portions in the direction perpendicular to the imaginary line, the second length is larger than 0.51 times the first length and smaller than 0.69 times the first length ($0.51*L1<L2<0.69*L1$).

* * * * *